US009890598B2

(12) United States Patent
Steen et al.

(10) Patent No.: US 9,890,598 B2
(45) Date of Patent: Feb. 13, 2018

(54) ANTI-ROTATION WEDGE

(71) Applicant: Vetco Gray Inc., Houston, TX (US)

(72) Inventors: Thomas L. Steen, Houston, TX (US); John E. Nelson, Houston, TX (US); Chau Hoang, Houston, TX (US); Daniel C. Benson, Houston, TX (US); Stephen D. Peters, Houston, TX (US)

(73) Assignee: Vetco Gray Inc., Houston, TX (US)

( * ) Notice: Subject to any disclaimer, the term of this patent is extended or adjusted under 35 U.S.C. 154(b) by 836 days.

(21) Appl. No.: 13/716,960

(22) Filed: Dec. 17, 2012

(65) Prior Publication Data

US 2014/0166308 A1 Jun. 19, 2014

(51) Int. Cl.
*F16L 15/00* (2006.01)
*E21B 17/08* (2006.01)

(52) U.S. Cl.
CPC ..... *E21B 17/08* (2013.01)

(58) Field of Classification Search
USPC ..... 285/91–92, 333–334, 355, 390, 39, 392
See application file for complete search history.

(56) References Cited

U.S. PATENT DOCUMENTS 3,259,162 A * 7/1966 Rosan ..... F16B 39/10 285/92
3,259,163 A * 7/1966 Rosan ..... F16B 37/125 285/92
3,913,670 A * 10/1975 Ahlstone ..... E21B 33/043 166/182
3,924,678 A * 12/1975 Ahlstone ..... E21B 33/043 166/120
4,615,544 A * 10/1986 Baugh ..... E21B 33/043 166/348
4,681,166 A * 7/1987 Cuiper ..... E21B 33/043 166/217
4,691,780 A * 9/1987 Galle, Jr. ..... E21B 33/043 166/208
4,711,471 A 12/1987 Pallini, Jr. et al.
4,757,593 A 7/1988 Pallini, Jr. et al.
4,902,047 A 2/1990 Marietta et al.
5,044,676 A 9/1991 Burton et al.
5,125,148 A * 6/1992 Krasnov ..... E21B 17/03 175/85
6,619,392 B2 9/2003 Marangoni et al.
6,695,059 B2 2/2004 Thomas et al.
7,146,704 B2 12/2006 Otten et al.
(Continued)

*Primary Examiner* — Aaron Dunwoody
*Assistant Examiner* — Fannie Kee
(74) *Attorney, Agent, or Firm* — Hogan Lovells US LLP

(57) ABSTRACT

A key assembly is press fit into an annular space between a box and pin member to resist relative rotation of the box and pin members. The key assembly includes wedge like members that contact one another along complementary tapered surfaces, and when in contact generate radial forces into the box and pin member to secure the connection between the box and pin. The outer wedge is inserted first into the annular space between the box and pin members, and has rows of elongate teeth that project radially outward into contact with an inner surface of the box member. Because the outer wedge is pushed radially outward against the box member rather than axially sliding therebetween, the teeth protrude into the surface of the box member thereby increasing the anti-rotation force created by the outer wedge.

16 Claims, 5 Drawing Sheets

(56) References Cited

U.S. PATENT DOCUMENTS

| | | | | |
|---|---|---|---|---|
| 8,474,876 | B2 * | 7/2013 | Watterson, II | E21B 17/043 285/39 |
| 2011/0260445 | A1 | 10/2011 | Watterson, II et al. | |
| 2012/0103625 | A1 | 5/2012 | Yates | |

* cited by examiner

ANTI-ROTATION WEDGE

FIELD OF THE INVENTION

This invention relates in general to threaded tubular connections, such as for offshore oil well large diameter pipe, and particularly to a device to prevent rotation of threaded members after they are made up.

BACKGROUND OF THE INVENTION

Oil and gas wells can have several strings of casing of differing diameters cemented in the well. Each casing string is usually made up of joints of pipe having threaded ends secured together. A typical casing joint has external threads on its upper and lower ends. A casing collar with internal threads secures the threaded ends together. In larger casing diameters, a box connector with internal threads may be affixed, such as by welding, to one end of each pipe, the other end having a pin connector with external threads. Normally, the operator relies on the friction of the made-up joint preventing the threaded connectors from loosening while running the string into the well. With larger diameter casing, for example, from 16 inch to 36 inch, the friction of the made-up connector may be inadequate to prevent loosening while running the casing.

Operators have employed anti-rotation keys to prevent loosening. A rectangular pocket or slot is machined on the outer surface of the pin connector. The box connector is machined to include tabs that accept the anti-rotation key. The box connector tab and pin connector pocket will line up after making up the connectors. The workers will then drive a key through the box connector tab and into the pin connector pocket. The key has a slightly greater thickness than the distance from the box connector tab to the innermost wall of the pin connector pocket, resulting in an interference fit. The workers typically will drive the key into place with a hammer. In some easing setups, the key inserts through a threaded hole in the box connector tab and a wrench may be employed to position and secure the key.

SUMMARY

Disclosed here in is an example of a connection system for a tubular string. In one example the system includes a box end on an end of a second tubular, a pin end on an end of a first tubular, where the first tubular is selectively inserted into the box end. Also included is a key assembly that includes interface and backing members that are wedged together in an annular space between the box end and pin end and frictionally couple to both the box end and pin end. A pocket can be provided in the annular space between the box end and pin end, wherein the pocket extends along a portion of the circumference of the box end. The interface and backing members may have complementary tapered surfaces, and wherein when the backing member is inserted into the annular space and the tapered surfaces are in sliding contact, the interface and backing members project radially outward into frictional engagement with the box and pin members. In an example, the interface member has teeth on a radially outward projecting surface that engage an inner surface of the box member when the backing member is inserted into the annular space. Optionally, an inset groove is formed on an outer radial surface of the backing member that is selectively engaged by a wedge installation tool. In one embodiment, the backing member has an upper portion and a lower portion, wherein the upper portion has a downward facing surface that selectively lands on an upper surface of the box end when the backing member is inserted into the annular space. In this example, the lower portion of the backing member has a tapered surface that is complementary to a tapered surface on a radially inward facing surface of the interface member. Further in this example, grooves are on the tapered surfaces of the backing member and the interface member.

Also disclosed herein is a connection joint for downhole tubulars, that in one example includes a box member having an open end, a pin member inserted into the open end to define an annular space between the box member and the pin member, an interface member in the annular space having an outer radial surface in contact with a portion of the pocket in the box member, and a backing member wedged into the annular space between the interface member and the pin member. In this example, a radial force is exerted across the interface member, backing member, pin member, and box member that counters a rotational force on one of the box member and pin member. Optionally, an inner radial surface of the backing member in the annular space contacts an outer radial surface of the pin member along an interface that is generally parallel with an axis of the pin member. The backing member can include an upper portion with an inset groove selectively engaged by a wedge installation tool. In an example, an outer radial surface of the backing member and inner radial surface of the interface member are tapered along complementary angles, so that when the backing member and interface member are inserted into the annular space, the backing member and interface member are in contact along an interface that is oblique with an axis of the pin member. The backing member can insert into a pocket formed on an outer surface of the pin member.

A method of handling a downhole tubing string is disclosed herein. In one example the method includes providing a wedge shaped interface member with teeth on an outer radius, inserting the interface member into an annular space between a pin member and a box member, providing a wedge shaped backing member, and inserting the backing member into the annular space and between the interface member and pin member. Inserting the backing member creates a radial force that is exerted into the box member and pin member that counters relative rotation of the box member and pin member. The teeth can project into the box member when the backing member is inserted into the annular space. Optionally, the backing member includes a groove on an outer radial surface, the method further involves coupling a hydraulic tool with the groove to insert the backing member into the annular space. In an example, the backing member includes a groove on an outer radial surface, the method further includes coupling a hydraulic tool with the groove to remove the backing member from the annular space. A pocket can be formed on an outer surface of the pin member, and wherein a portion of the backing member inserts into the pocket.

DETAILED DESCRIPTION OF THE INVENTION

Figure 1:
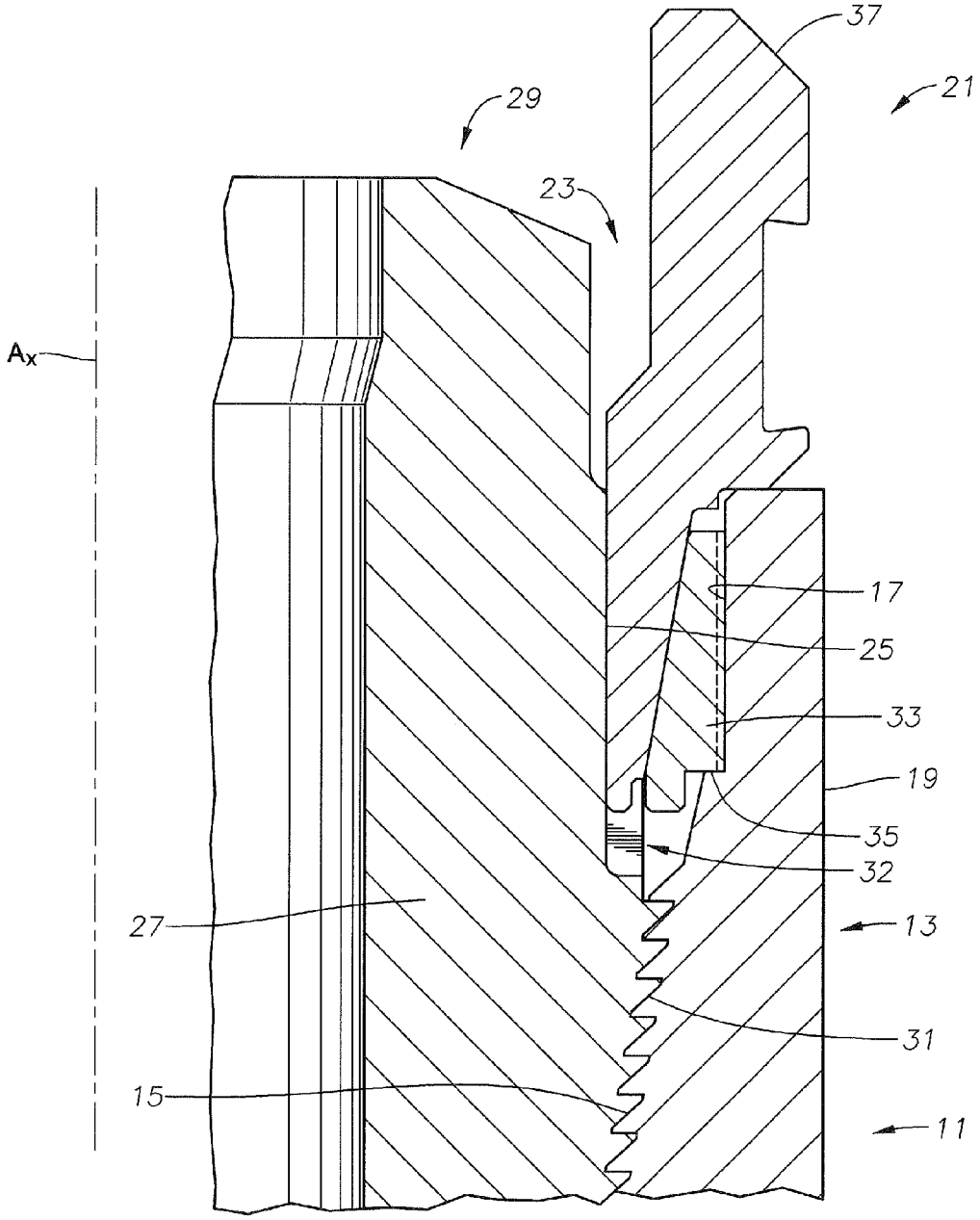
FIG. 1 is a side partial sectional view of an example of a tubular connection secured by an embodiment of an anti-rotation system in accordance with the present invention.
Figure 6:
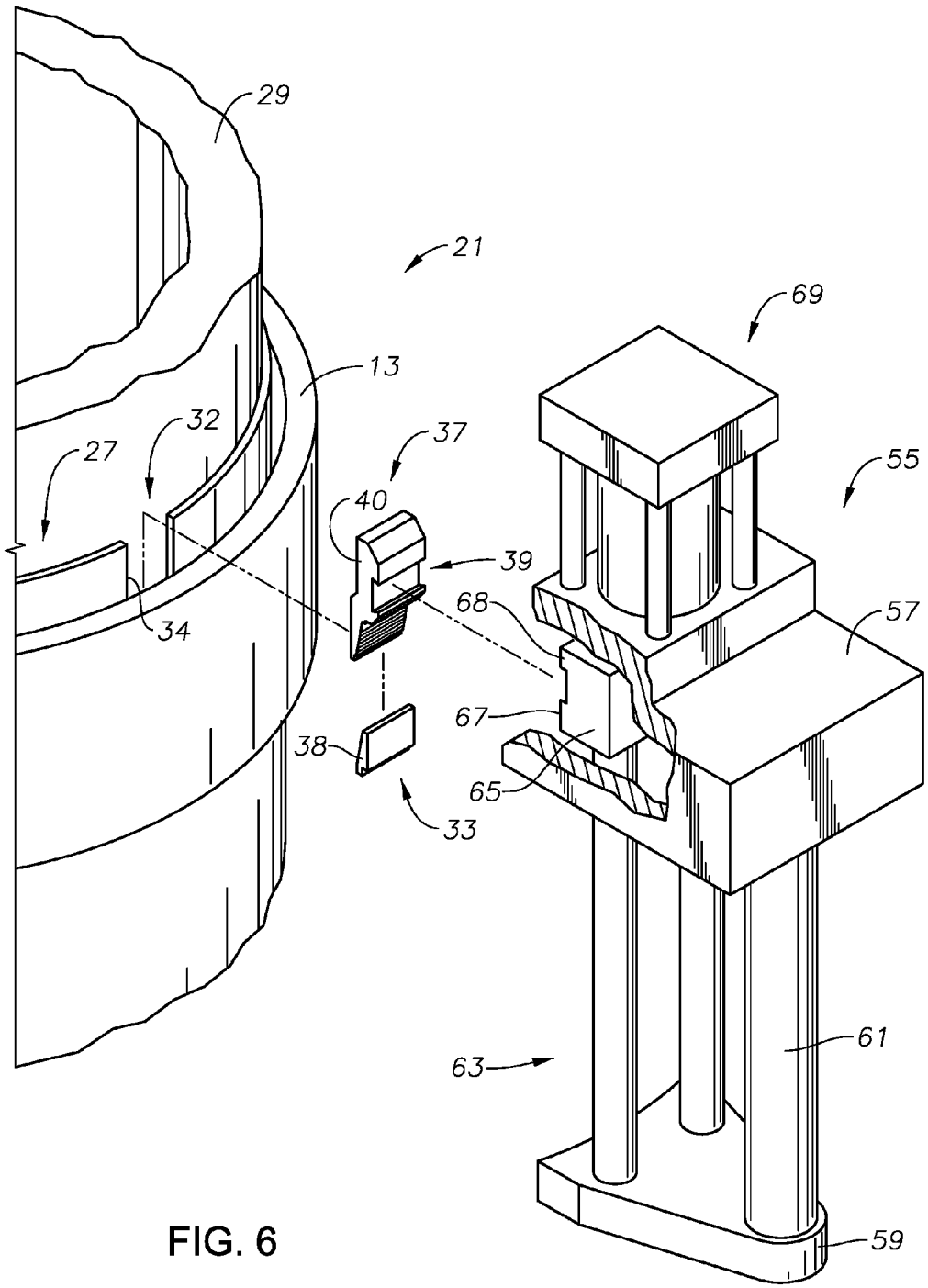
FIGS. 6 and 7 are side perspective views of an example of a key handling tool installing interface and backing members in a tubular connection and in accordance with the present invention.

Referring to FIG. 1, a first pipe 11 has a cuff-like box member 13 on one end with internal threads 15 on an inner surface adjacent box member 13. The internal diameter of pipe 11 increases along the portion having threads 15 and proximate box member 13. The box member 13 has a smooth surfaced internal rim 17 circumscribing an upper inner surface. In this embodiment, the box member 13 has an outer surface 19 that is substantially smooth. A pipe connection 21 is shown having a annular space 23 formed by the internal rim 17 of the box member 13 and between an outer surface 25 of a pin member 27. The pin member 27 is formed on the end of a second pipe 29 and has a set of external threads 31 that engage with the internal threads 15 of the box member 13. The second pipe 29 and the box member 13 are rotated relative to each other to make up a joint. A pocket 32 is shown formed into the outer surface of the pin member and radially inward from annular space 23. In the example of FIG. 1, the pocket 32 extends along a portion of the circumference of the annular space 23. As shown in FIG. 6, pocket 32 has side edges 34 that extend axially, are spaced circumferentially apart from each other a selected distance, and face each other. In an alternate embodiment, a series of pockets 32 are provided along the circumference of the pipe connection 21.

An interface member 33 is shown having outward facing teeth, which can be selectively inserted into the annular space 23. The interface member 33 has a lower support shoulder 35 that rests against the bottom portion of the annular space 23 for positioning the interface member 33 in preparation for insertion of a backing member 37. The backing member 37 can be selectively inserted into the annular space 23, and so its lower portion is within pocket 32. Referring to FIG. 6, interface member 33 has circumferentially spaced apart axially extending side edges 38 that face in opposite directions. Backing member 37 has circumferentially spaced apart axially extending side edges 40, each of which faces one of the pocket side edges 34 when backing member 37 is inserted into pocket 32. The circumferential width of interface member 33 is the same as the circumferential width of backing member 37. The presence of the backing member 37 in the pocket 32 radially directs the previously inserted interface member 33 towards the internal rim 17 of the box member 13, thereby rotationally coupling the first pipe 11 and the second pipe 29. In an example, the backing member 37 and interface member 33 define a key assembly that when wedged into the annular space 23 engage with each other and frictionally engage the box and pin members 13, 27 thereby rotationally coupling the box and pin members 13, 27. In the example of FIG. 1, the outer radial or partially cylindrical surface of the interference member 33 and inner radial or partially cylindrical surface of the backing member 37 are each generally concentric with an axis AX of pipe 29. However, alternate embodiments exist where one or both of the inner and outer partially cylindrical surfaces of members 33, 37 are oblique to the axis AX.

Figure 2:
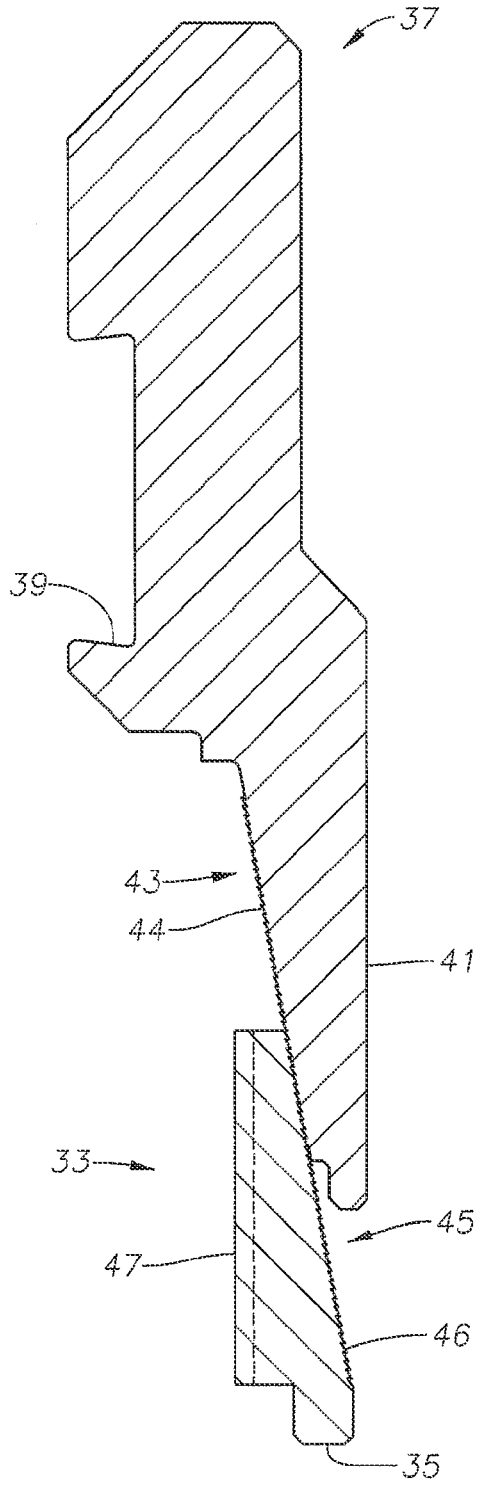
FIG. 2 is a side elevational view of interface and backing members of the anti-rotation system of FIG. 1 in an unset configuration and in accordance with this invention.

FIG. 2 illustrates a side elevational view of an example of an unset position of the interface member 33 and the backing member 37. The lower support shoulder 35 of the interface member rests in the annular space 23 (as shown in FIG. 1), while the backing member 37 is pushed downward into the annular space 23. In an embodiment, the backing member 37 can have a generally rectangular upper portion having a beveled surface on an upper edge that faces radially outward. An inset groove 39 is provided on the outer radial surface, which has a generally rectangular cross section. A lower portion of the backing member 37 depends down from its upper portion having a generally triangularly shaped cross section to define a wedge shaped section 41. The wedge shaped section 41 has a radially outward facing tapered surface 43 profiled with a series of grooves 44 extending along its width. Further in the example of FIG. 2, a lower end of tapered surface 43 is shown mating with an upper end of a tapered surface 45 provided on a radially inward facing side of the backing member 37. Grooves 46 are formed along a width of tapered surface 45 that engage grooves 44. In one embodiment, surfaces 43, 45 are tapered to complementary angles, so that when the backing member 37 slides into engagement with the interface member 33, an interface is formed along an axial length of these surfaces 43, 45 that is oblique to the axis $A_X$ (FIG. 1).

Figure 3:
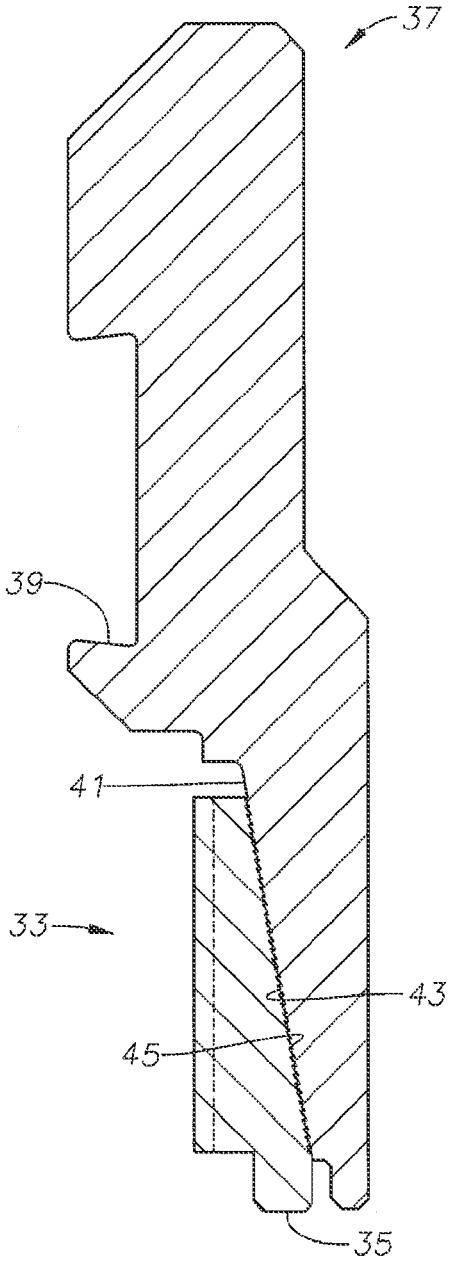
FIG. 3 is a side elevational view of interface and backing members of the anti-rotation system of FIG. 1 in a set configuration and in accordance with this invention.

FIG. 3 illustrates a side elevational view of the interface member 33 and the backing member 37 in a set position and with their respective grooves 44, 46 engaged with one another. Moreover, inserting the backing member 37 into the annular space 23 so the tapered surfaces 43, 45 are facing one another, exerts a radial force against the box and pin members 13, 27 that urge teeth 47 on a radially outward facing side of the interface member 33 to engage with a radially inward facing surface of internal rim 17. The teeth 47 extend along an axial path and are generally transverse to grooves 46. Engaging the teeth 47 with rim 17, in combination with radially inwardly pushing backing member against pin member 27, generates forces on the pipes 11, 29 that opposes their relative rotational movement, thereby maintaining the pipe connection 21. Once installed the first pipe 11 and the second pipe 29 are rotationally coupled together (as shown in FIG. 1). One advantage of radially installing the interface member 33, as described in this embodiment, is that the teeth do not need to axially plow through the receiving material, such as internal rim 17 of the box member 13. By not plowing through this part of the box 13, the box 13 may last longer in an installation or be used for more installation attempts and the tubulars can see an extended useful life.

Figure 4:
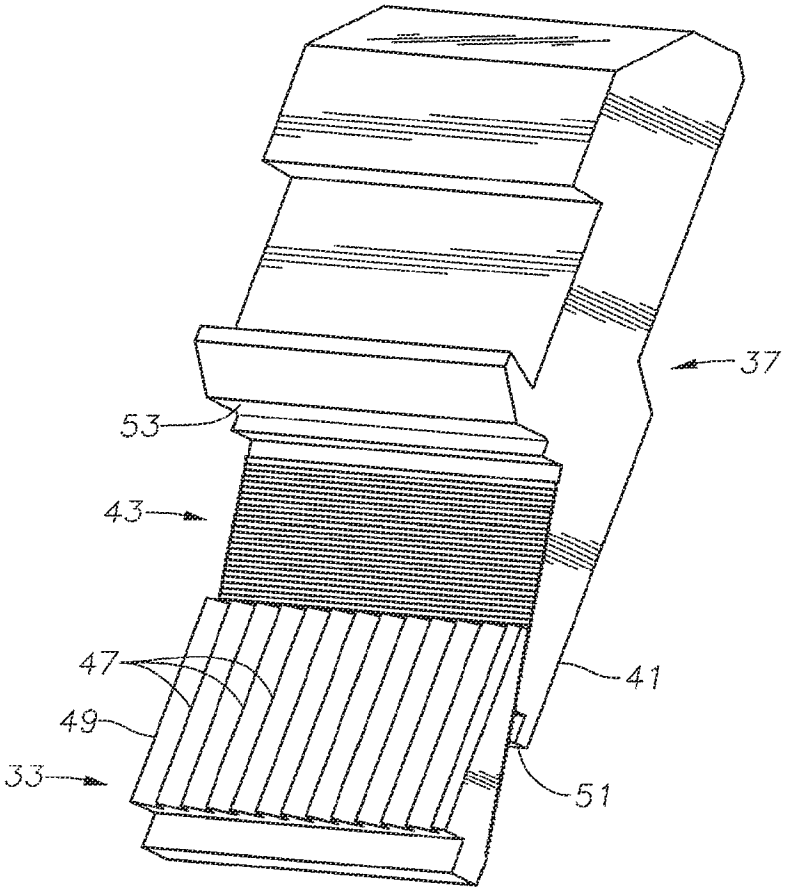
FIG. 4 is a perspective view of interface and backing members of the anti-rotation system FIG. 1 in an unset configuration and in accordance with this invention.

FIG. 4 shows a side perspective view showing the unset position of the interface member 33 and the backing member 37. As shown, the teeth 47 are aligned in rows that project outward from radially outward facing surface 49 of the interface member 33. Each tooth has lateral sides that meet to define an edge along the terminal end of each tooth. In an alternate embodiment, teeth 47 may cover only a portion of surface 49. As noted above, the tapered surfaces 43, 45 slide against one another as the backing member 37 is being installed in the annular space 23. A stab guide 51 on a lower terminal end of the backing member 37 projects into a bottom of the annular space 23, and a blocking shoulder 53 on a lower facing surface of the upper portion of the backing member 37 lands on an upper surface of rim 17 to provide a stopping position and support for the backing member 37.

In an example, the shoulder 53 is supported on the rim when the backing member 37 is in the installed position (FIG. 1).

Figure 5:
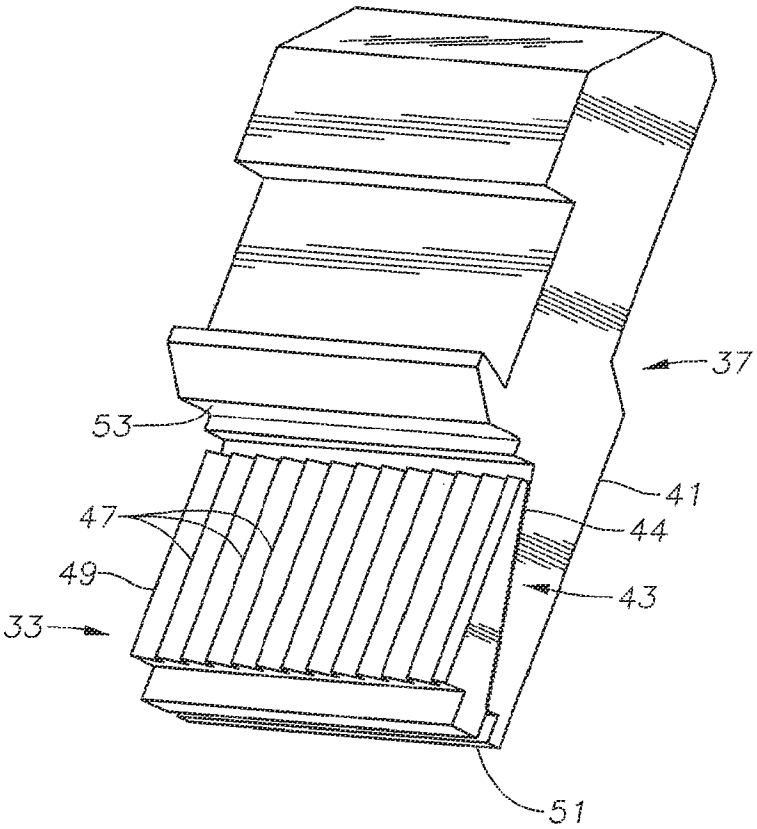
FIG. 5 is a perspective view of interface and backing members of the anti-rotation system of FIG. 1 in a set configuration and in accordance with this invention.

FIG. 5 shows a side perspective view an example of the set position of the interface member 33 and the backing member 37. In an alternate embodiment, guide rails (not shown) can be on the tapered surface 43 of the backing member 37. In an example, the guide rail(s) are elongated members that project upward from the tapered surface 43 and extend along a path generally parallel with relative movement of the backing member 37 and interface member 33. In this example, one or more recesses (not shown) can be provided on the tapered surface 45 in which guide rail(s) are received. The guide rails can help to align the backing member 37 as it is inserted into annular space 23. The guide rails can also serve to better align the engagement of the teeth 47 of the interface piece 33.

Shown in perspective view in FIG. 6, is one example of securing a pipe connection against rotation by installing an interface member 33 and backing member 37 with a key installation tool 55. The example tool 55 includes a main body 57 shown supported over a base 59 by a support rod 61. Also extending between the base 59 and body 57 are guide rods 63 shown substantially parallel to and forward of the support rod 61. The guide rods 63 insert into bores (not shown) formed axially through a ram 65 that is slidingly mounted on the rods 63. A tongue 67 is formed on a forward facing surface of the ram 65. The tongue 67 projects forward from the ram 65 in a direction opposite from support rod 61, and extends lengthwise across the forward facing surface of the ram 65. A shoulder 68 is also provided on an upper edge of the ram that extends lengthwise along its forward facing surface. The ram 65 is actuated on the guide rods 63 by hydraulic fluid stored in a cylinder 69 mounted on an upper surface of the body 57. Further illustrated in FIG. 6 is that the sidewalls of the pocket 32 are sufficiently spaced apart to allow insertion of the backing member 37 therebetween. Strategic spacing of the sidewalls maintains the backing member 37 at a designated azimuth along the outer surface of the pin member 27.

Figure 7:
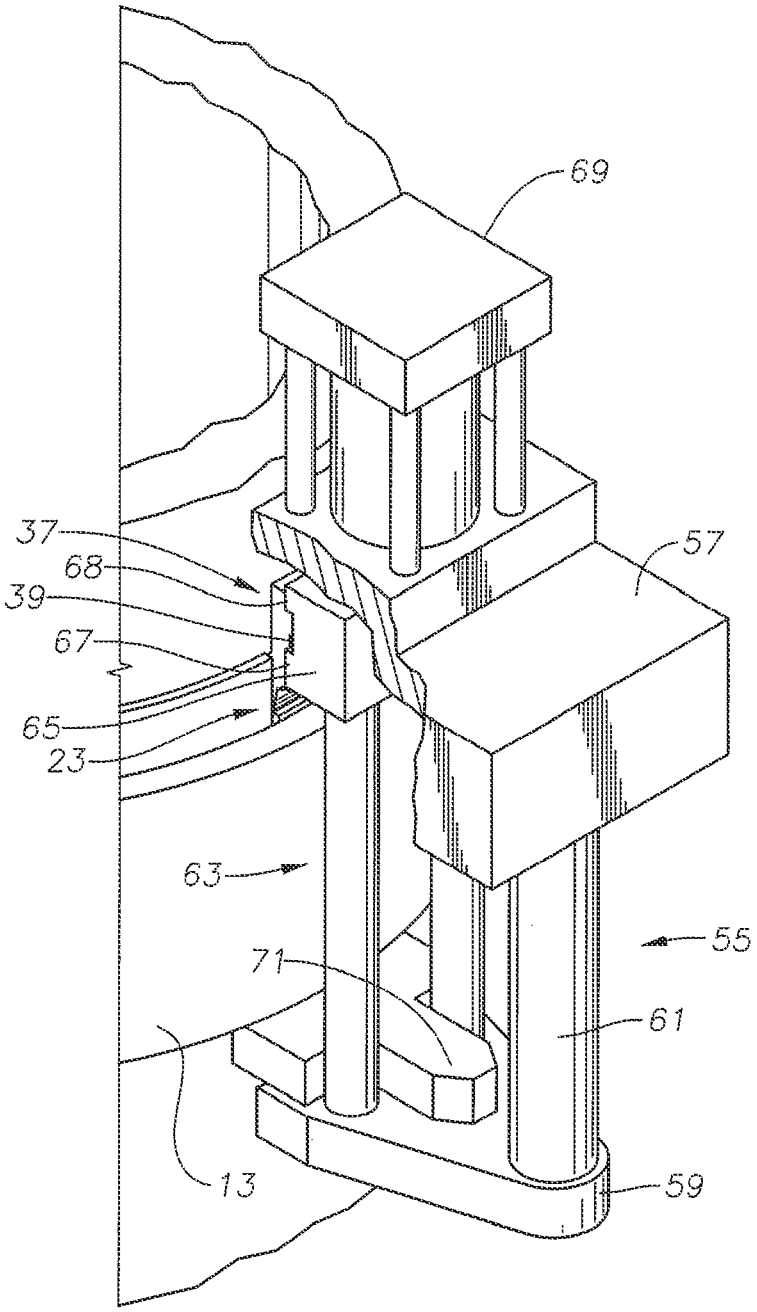

FIG. 7 illustrates an example of using the key installation tool 55 to insert the backing member 37 into annular space 23 and into engagement with interface member 33 (FIG. 6). In this example, a forward facing edge of the body 57 rests against box member 13, and tongue 67 is inserted into groove 39. Further, shoulder 68 engages an upper surface of backing member 37. Hydraulic fluid is supplied to ram 65 via cylinder 69, which in turn urges ram 65 downward to force backing member 37 into annular space 23. Through its interaction of the tongue 67 into groove 39, and shoulder 68 on the upper end of backing member 37, the ram 65 exerts sufficient force onto backing member 37 to insert it into the annular space 23 and to engage interface member 33. An optional cleat 71 can be included on the base 59 for engaging a lower facing surface of box member 13. In the example of FIG. 7, cleat 71 is a generally planar member that has a portion extending between guide rods 63, and a transverse forward portion that extends along a forward edge of the base 59 distal from support rod 61.

The invention claimed is:

1. A connection system for a tubular string comprising:

a box end having internal threads on an end of a first tubular;

a pin end having external threads on an end of a second tubular that is selectively insertable into the box end, the box end and the pin end having a common axis and the internal threads engaging the external threads when connected together;

a pocket between the box end and the pin end, the pocket having side edges spaced circumferentially apart and facing each other;

a key assembly in the pocket comprising an interface member and a backing member, one of the interface member and the backing member being located in the pocket, the backing member being axially movable relative to the interface member from an unset position to a set position in between the box end and the pin end; and wherein the interface member and the backing member have complementary tapered surfaces in sliding contact with each other while the backing member moves axially relative to the interface member, which wedges the interface member and the backing member into frictional engagement with the box end and the pin end while in the set position to resist rotation of the box end and the pin end relative to each other.

2. The connection system of claim 1, wherein the backing member has an inward facing partially cylindrical surface that is in contact with the pin end, and the interface member has an outward facing partially cylindrical surface that is in contact with the box end.

3. The connection system of claim 1, wherein the backing member is located in the pocket while in the set position.

4. The connection system of claim 1, wherein the interface member has axially extending teeth on a radially outward projecting surface that engage and project radially into an inner surface of the box end when the backing member is moved axially relative to the interface member from the unset position to the set position.

5. The connection system of claim 1, wherein an inset groove is formed on an outer surface of the backing member that faces away from the axis, the inset groove being configured to be selectively engaged by a wedge installation tool to move the backing member to the set position.

6. The connection system of claim 1, wherein the backing member has an upper portion and a lower portion, wherein the upper portion has a downward facing surface that selectively lands on a rim on an upper surface of the box end when the backing member is in the set position.

7. The connection system of claim 1, further comprising:

an internal support shoulder within the box end; and wherein the interface member lands on the support shoulder while the backing member and the interface member are in the set position.

8. The connection system of claim 1, further comprising grooves on the tapered surfaces on the backing member and the interface member, the grooves being transverse to the axis, and the grooves on the tapered surface of the backing member engaging the grooves on the tapered surface of the interface member while the backing member and the interface member are in the set position.

9. A connection joint for downhole tubulars, comprising:

a box member having an open end and internal threads;

a pin member inserted into the open end to define an annular space between the box member and the pin member, the pin member having external threads that connect with the internal threads in response to tightening relative rotation between the box member and the pin member, the box member and the pin member having a common axis when connected together;

a pocket formed on an external cylindrical surface of the pin member, the pocket having axially extending side edges that are circumferentially spaced apart from each other and face each other;

an interface member in the annular space having a partially cylindrical outer surface in contact with a cylindrical portion of the box member, the interface member having a tapered surface that faces toward the axis and inclines at an angle relative to the axis, the interface member having circumferentially spaced apart side edges that face in opposite directions:

a backing member inserted into the pocket, the backing member having circumferentially spaced apart side edges, each of which faces one of the side edges of the pocket, the backing member being axially movable relative to the interface member, the backing member having a tapered surface that faces away from the axis and slides against the tapered surface of the interface member while the backing member is moved axially relative to the interface member; and wherein the backing member wedges between the interface member and the pin member while moving from an unset to a set position, so that a radial force is exerted between the interface member, the backing member, the pin member, and the box member that counters a loosening rotational force on one of the box member and pin member relative to the other of the box member and the pin member.

10. The connection joint of claim 9, further comprising axially extending teeth on the outer surface of the interface member that move radially and project into the cylindrical portion of the box member when the backing member is moved axially relative to the interface member from the unset position to the set position.

11. The connection joint of claim 9, wherein the backing member has an upper portion with an inset groove facing away from the axis that is configured to be selectively engaged by a wedge installation tool to move the backing member to the set position.

12. The connection joint of claim 9, further comprising:

a plurality of grooves on at least one of the tapered surfaces, the grooves extending along lines perpendicular to the axis.

13. The connection joint of claim 9, further comprising a plurality of grooves on each of the tapered surfaces, the grooves extending along lines perpendicular to the axis, the grooves on one of the tapered surfaces frictionally engaging the grooves on the other of the tapered surfaces to resist movement of the backing member from the set position.

14. A connection joint for downhole tubulars, comprising:

a box member having internal threads and an open upper end;

a pin member inserted into the upper end to define an annular space between the box member and the pin member, the box member having external threads that engage the internal threads in response to tightening relative rotation between the pin member and the box member;

a pocket formed on one of the box member and the pin member in the annular space, the pocket having axially extending side edges that face each other;

an interface member in the annular space, the interface member having an interface member tapered surface that is at an oblique angle relative to an axis of the box member;

a backing member inserted into the pocket, the backing member having a backing member tapered surface at an oblique angle that is the same as the oblique angle of the interface member tapered surface;

the backing member being axially movable in the pocket relative to the interface member, the axial movement causing the backing member tapered surface to slide axially along the interface member tapered surface to a set position, wherein the backing member and the interface member are wedged between the pin member and the box member; and a plurality of axially extending teeth on an opposite side of the interface member from the interface member tapered surface that project radially into an inner cylindrical surface of the box member as the backing member moves axially to the set position.

15. The connection joint of claim 14, further comprising:

a set of interface member grooves on the interface member tapered surface that are perpendicular to the axis;

a set of backing member grooves on the backing member tapered surface that are perpendicular to the axis; and wherein the backing member grooves engage the interface member grooves while the backing member tapered surface slides along the interface member tapered surface.

16. The connection joint of claim 14, wherein the interface member has axially extending side edges that face in opposite directions.

* * * * *